US010941761B2

(12) United States Patent
Gilcrease

(10) Patent No.: US 10,941,761 B2
(45) Date of Patent: Mar. 9, 2021

(54) REAR LEG CONNECTION FOR BEAM PUMPING UNIT

(71) Applicant: Ravdos Holdings Inc., New York, NY (US)

(72) Inventor: Aaron Bruce Gilcrease, Lufkin, TX (US)

(73) Assignee: Ravdos Holdings Inc., New York, NY (US)

( * ) Notice: Subject to any disclaimer, the term of this patent is extended or adjusted under 35 U.S.C. 154(b) by 619 days.

(21) Appl. No.: 15/408,335

(22) Filed: Jan. 17, 2017

(65) Prior Publication Data

US 2018/0202596 A1 Jul. 19, 2018

(51) Int. Cl.

| | |
|---|---|
| ***F04B 47/00*** | (2006.01) |
| ***F04B 47/02*** | (2006.01) |
| ***F04B 53/22*** | (2006.01) |
| ***F04B 19/22*** | (2006.01) |
| ***E21B 43/12*** | (2006.01) |

(52) U.S. Cl.

CPC ..... *F04B 47/00* (2013.01); *F04B 47/028* (2013.01); *F04B 53/22* (2013.01); *E21B 43/127* (2013.01); *F04B 19/22* (2013.01); *F04B 47/022* (2013.01)

(58) Field of Classification Search

CPC . F16M 5/00; F04B 47/00; F04B 47/02; F04B 47/022; F04B 47/028; E04C 3/08

USPC ..... 71/41

See application file for complete search history.

(56) References Cited

U.S. PATENT DOCUMENTS

| | | | | |
|---|---|---|---|---|
| 2,271,086 A * | 1/1942 | Maier | E21B 43/127 | 74/41 |
| 2,308,823 A * | 1/1943 | Phipps | F04B 47/02 | 74/41 |
| 4,603,592 A * | 8/1986 | Siebold | F04B 47/028 | 166/72 |
| 4,703,665 A | 11/1987 | Thompson | | |
| 4,788,873 A | 12/1988 | Laney | | |
| 4,957,186 A | 9/1990 | Reetz | | |
| 6,015,271 A * | 1/2000 | Boyer | F04B 47/022 | 417/321 |

(Continued)

FOREIGN PATENT DOCUMENTS

| | | |
|---|---|---|
| CN | 2266040 Y | 10/1997 |
| CN | 204922409 U | 12/2015 |

OTHER PUBLICATIONS

International Search Report and Written Opinion issued in connection with corresponding PCT Application No. PCT/US2018/023137 dated Jul. 25, 2018.

(Continued)

*Primary Examiner* — Orlando E Aviles
*Assistant Examiner* — Seahee Hong
(74) *Attorney, Agent, or Firm* — Dentons Cohen & Grigsby P.C.

(57) ABSTRACT

A pump jack includes a base, a pedestal supported by the base and a Samson post that supports a walking beam. The Samson post includes a front leg that is supported by the base and a connection bracket affixed to the front leg. The Samson post further includes an adjustable rear leg that is connected between the connection bracket and the pedestal. The rear leg can be rotated and shifted up and down within the connection bracket to ensure that the opposite end of the rear leg is properly located on the pedestal.

16 Claims, 7 Drawing Sheets

(56) References Cited

U.S. PATENT DOCUMENTS

| | | | | |
|---|---|---|---|---|
| 6,499,266 | B1 | 12/2002 | Macumber | |
| 8,240,221 | B2 | 8/2012 | Simpson et al. | |
| 2009/0107267 | A1 | 4/2009 | Mullin | |
| 2012/0031208 | A1 * | 2/2012 | Simpson ..... | F04B 47/02 74/41 |

OTHER PUBLICATIONS

Lufkin Industries, LLC; Lufkin Pumping Unit Gen2 Advertisement.
International Preliminary Report on Patentability; PCT/US2018/023137; Mailed Aug. 1, 2019.

* cited by examiner

REAR LEG CONNECTION FOR BEAM PUMPING UNIT

FIELD OF THE INVENTION

This invention relates generally to oilfield equipment, and more particularly, but not by way of limitation, to a beam pumping unit with an improved rear leg connection.

BACKGROUND

Hydrocarbons are often produced from well bores by reciprocating downhole pumps that are driven from the surface by pumping units. A pumping unit is connected to its downhole pump by a rod string. Although several types of pumping units for reciprocating rod strings are known in the art, walking beam style pumps enjoy predominant use due to their simplicity and low maintenance requirements.

In most walking beam pumping units, the walking beam is pivotally supported atop a Samson post through a saddle bearing assembly. Typically, the Samson post includes a front leg and a rear leg that are secured to one another by a connection bracket below the saddle bearing assembly. The distal end of the front leg is secured to the base of the pumping unit. The distal end of the rear leg can be secured to the pedestal or to the base of the pumping unit with large bolts. The Samson post carries a significant amount of weight and is exposed to lateral forces during the operation of the pumping unit.

The Samson post, walking beam and base are typically assembled at the well site. Inconsistencies in the manufacturing or assembly processes may cause the distal end of the rear leg to contact the horizontal supporting surface at an angle. If this occurs, the bolts connecting the rear leg to the pedestal or base may be exposed to additional shear and tensile forces. These forces may exceed the design rating of the bolts and cause the bolts to fail. There is, therefore, a need for a cost-effective solution for constructing the Samson post that facilitates assembly and reduces the risk of bolt failure. It is to these and other deficiencies in the prior art that the present invention is directed.

SUMMARY OF THE INVENTION

In one aspect, the present invention includes a pump jack that has a base, a pedestal supported by the base and a Samson post that supports a walking beam. The Samson post includes a front leg that is supported by the base and a connection bracket affixed to the front leg. The Samson post further includes an adjustable rear leg that is connected between the connection bracket and the pedestal. The rear leg can be rotated and shifted up and down within the connection bracket to ensure that the opposite end of the rear leg is properly seated on the top surface of the pedestal.

In another aspect, the present invention includes a pump jack that has a base, a pedestal supported by the base and a Samson post. The Samson post includes a front leg supported by the base, a connection bracket affixed to the front leg and a rear leg connected between the connection bracket and the pedestal. The position of the rear leg within the connection bracket can be adjusted during assembly.

In yet another aspect, the present invention provides a method of assembly a pump jack. The method begins with providing a front leg of a Samson post that has connection bracket is attached to the front leg. The method also includes the preparatory step of providing a rear leg of the Samson post that has a proximal end, a distal end and a rear foot attached to the distal end. Next, the method includes the step of securing a pedestal on the base. The method continues with the step of attaching a lower end of the front leg to the base at a predetermined location. Next, the method includes the step of attaching the proximal end of the rear leg within the connection bracket in an initial position. The method continues with the step of moving the distal end of the rear leg of the Samson post to a final position in which the rear foot is flat on the top surface of the pedestal. Lastly, the method includes the step of securing the rear leg and rear foot in the final position.

WRITTEN DESCRIPTION

Figure 1:
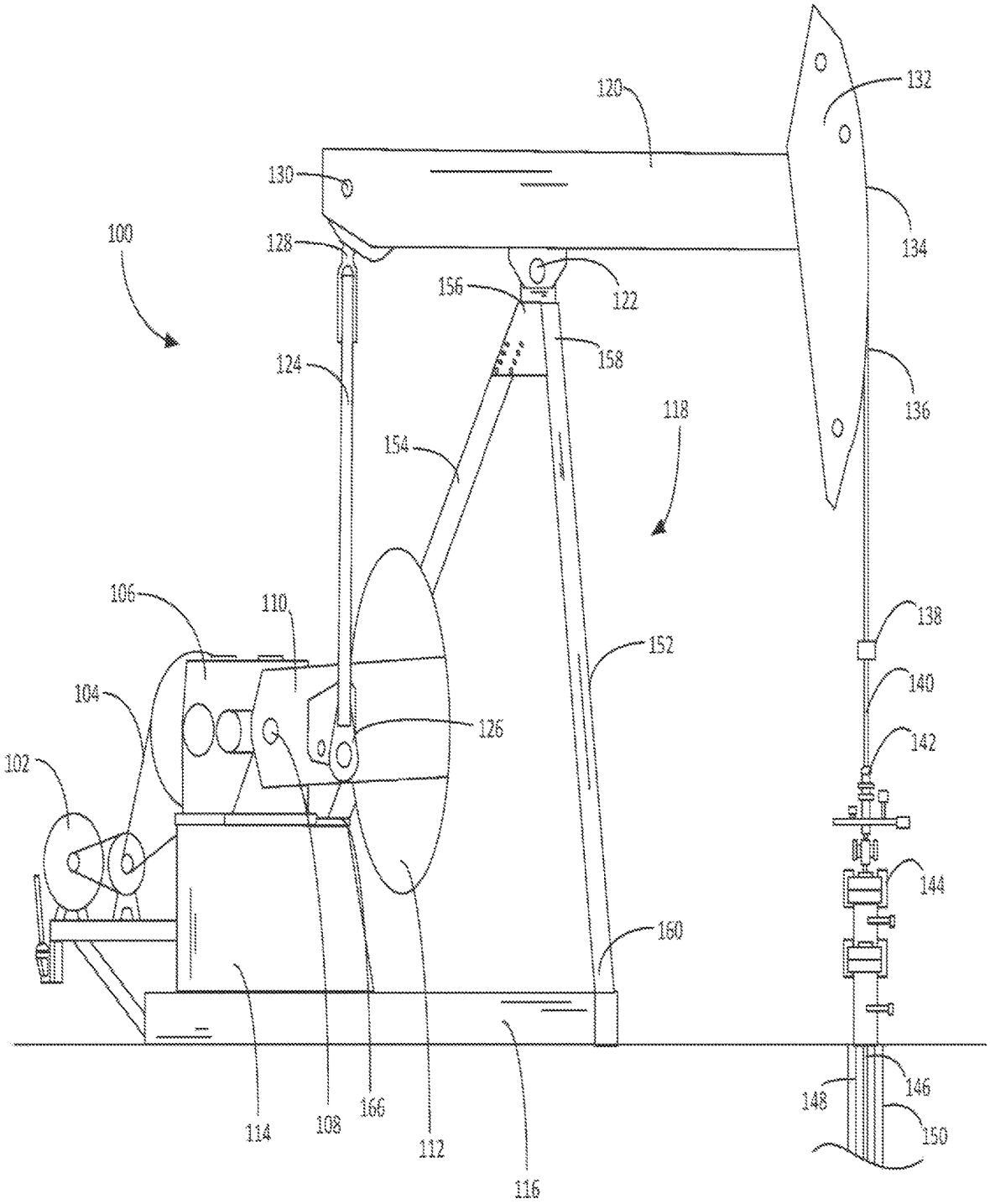
FIG. 1 is a side view of a pump jack constructed in accordance with an exemplary embodiment.

FIG. 1 shows a class 1 beam pump jack 100. The pump jack 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The reducer gearbox 106 sits atop a sub-frame or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a saddle bearing assembly 122, commonly referred to as a center bearing assembly.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polished rod 140 is suspended.

The polished rod 140 extends through a packing gland or stuffing box 142 on a wellhead 144. A rod string 146 of sucker rods hangs from the polished rod 140 within a tubing string 148 located within the well casing 150. The rod string is connected to the plunger of a subsurface pump (not illustrated). In a reciprocating cycle of the pump jack 100, well fluids are lifted within the tubing string 148 during the rod string 146 upstroke.

Figure 2:
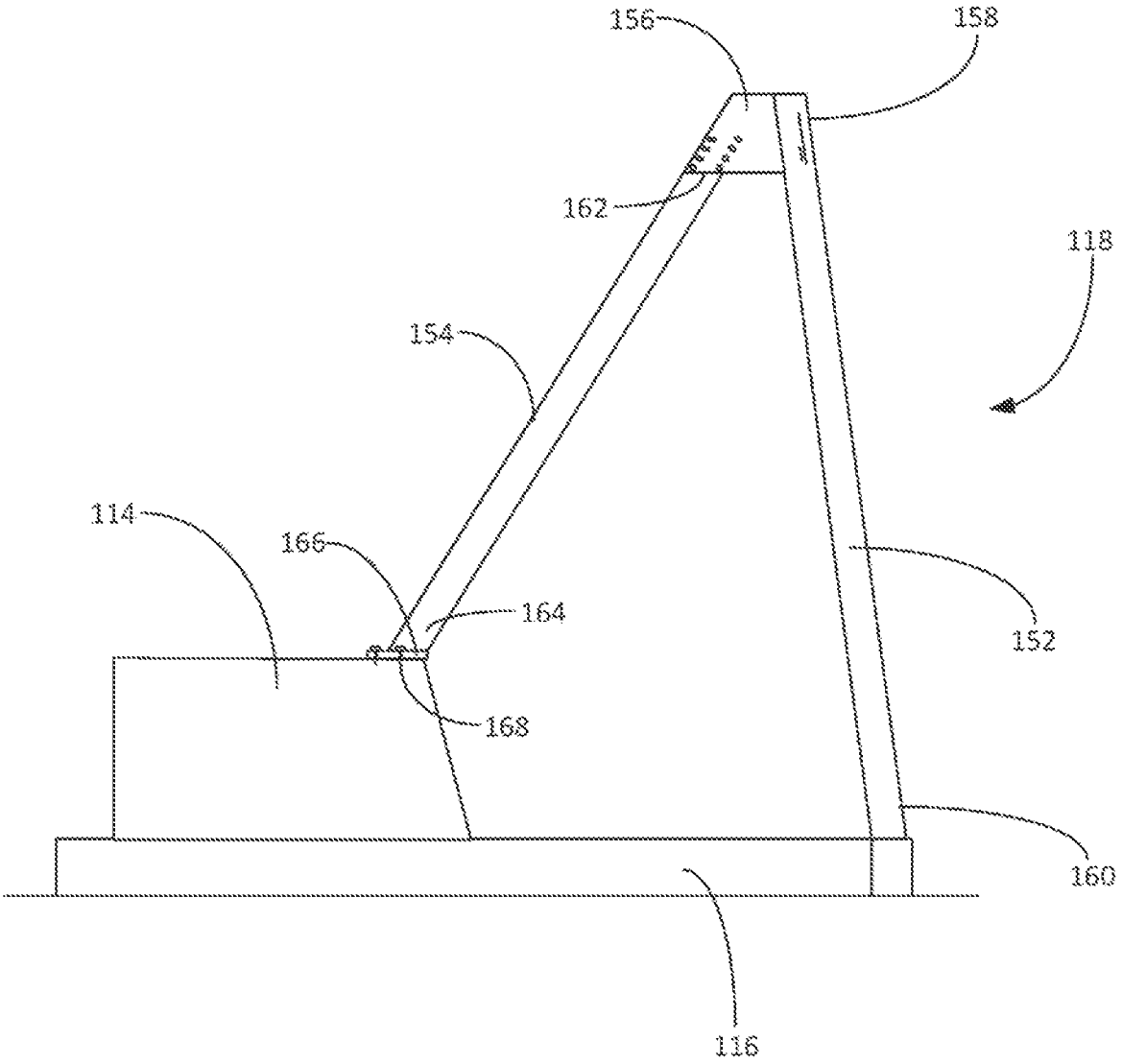
FIG. 2 is a side view of the Samson post and frame of the pump jack of FIG. 1.

As more clearly shown in FIG. 2, the Samson post 118 includes a front leg 152, a rear leg 154 and a connection bracket 156. In the embodiment depicted in FIGS. 1 and 2, the connection bracket 156 is rigidly affixed to an upper end 158 of the front leg 152. The connection bracket 156 can be secured to the front leg 152 with a welded or bolted connection. A lower end 160 of the front leg 152 is rigidly secured to the base 116 at a predetermined and fixed angle. In this way, the front leg 152 and connection bracket 156 are held in a fixed geometric relationship with the base 116.

The rear leg 154 includes a proximal end 162 that is retained by the connection bracket 156. The rear leg 154 includes a distal end 164 that terminates in a rear foot 166. The rear foot 166 is attached to the distal end 164 at a fixed angle with a welded or bolted connection. The rear foot 166 secures the rear leg 154 to the pedestal 114 with Samson pedestal bolts 168. Significantly, the rear leg 154 is captured between the connection bracket 156 and pedestal 114 such that the length and angular disposition of the rear leg 154 can be adjusted to ensure that the rear foot 166 is flat with the top of the pedestal 114 to reduce stress on the Samson pedestal bolts 168. The adjustable rear leg 154 presents an important advancement over the prior art.

Figure 3:
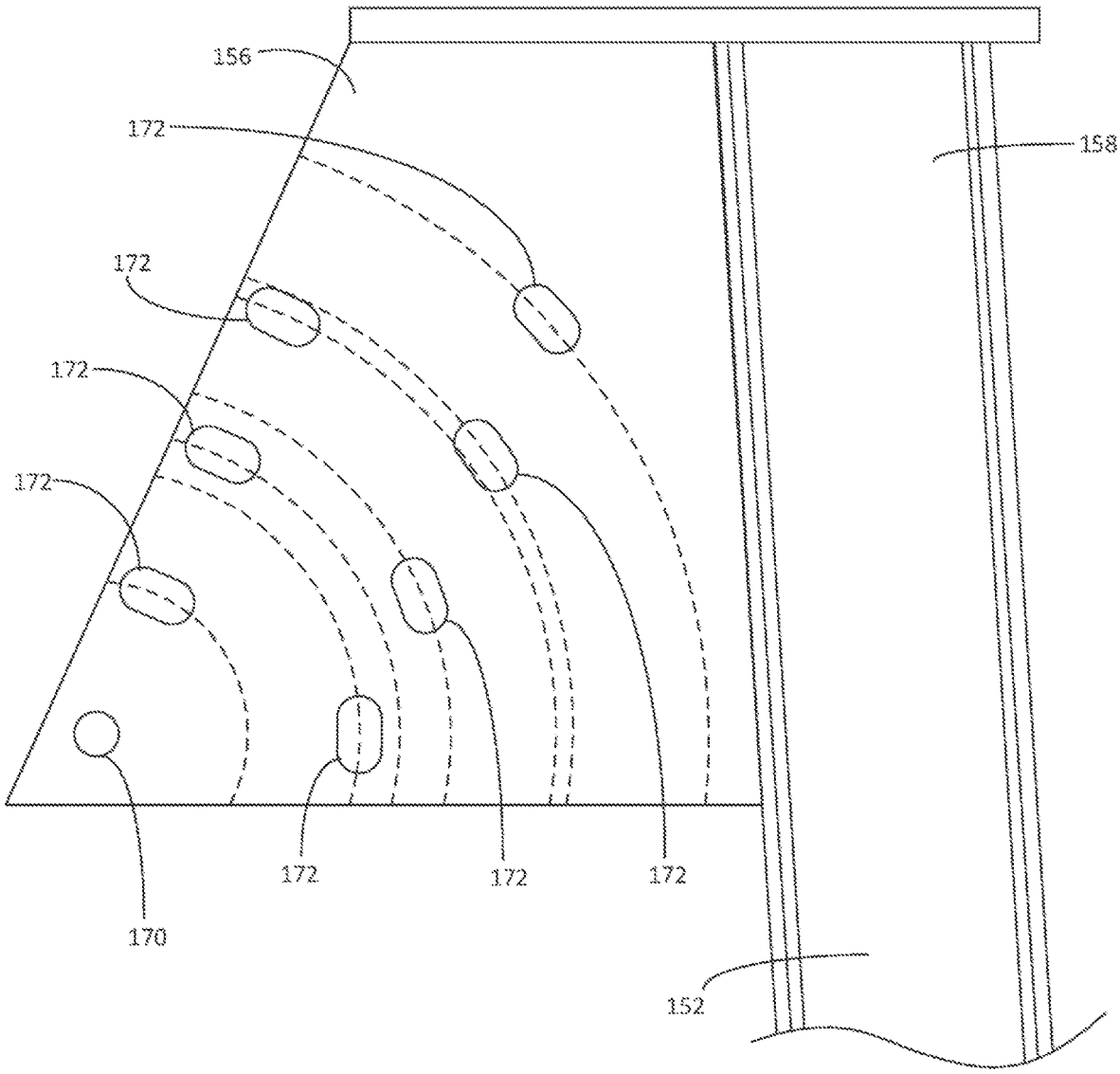
FIG. 3 is a side view of the Samson post connection bracket of the pump jack of FIG. 1.

Turning to FIG. 3, shown therein is a close-up view of the connection bracket 156 and upper end 158 of the front leg 152. The connection bracket 156 includes a reference bracket hole 170 and a plurality of compensating bracket bolt holes 172 (collectively, "bracket bolt holes 170, 172"). In the exemplary embodiment depicted in FIG. 3, the compensating bracket bolt holes 172 are elongated bolt holes having a linear axis 171 extending along a length of the elongated bolt hole and aligned along the arc of circles (shown in dashed lines) with a common center at the reference bracket bolt hole 170.

Figure 4:
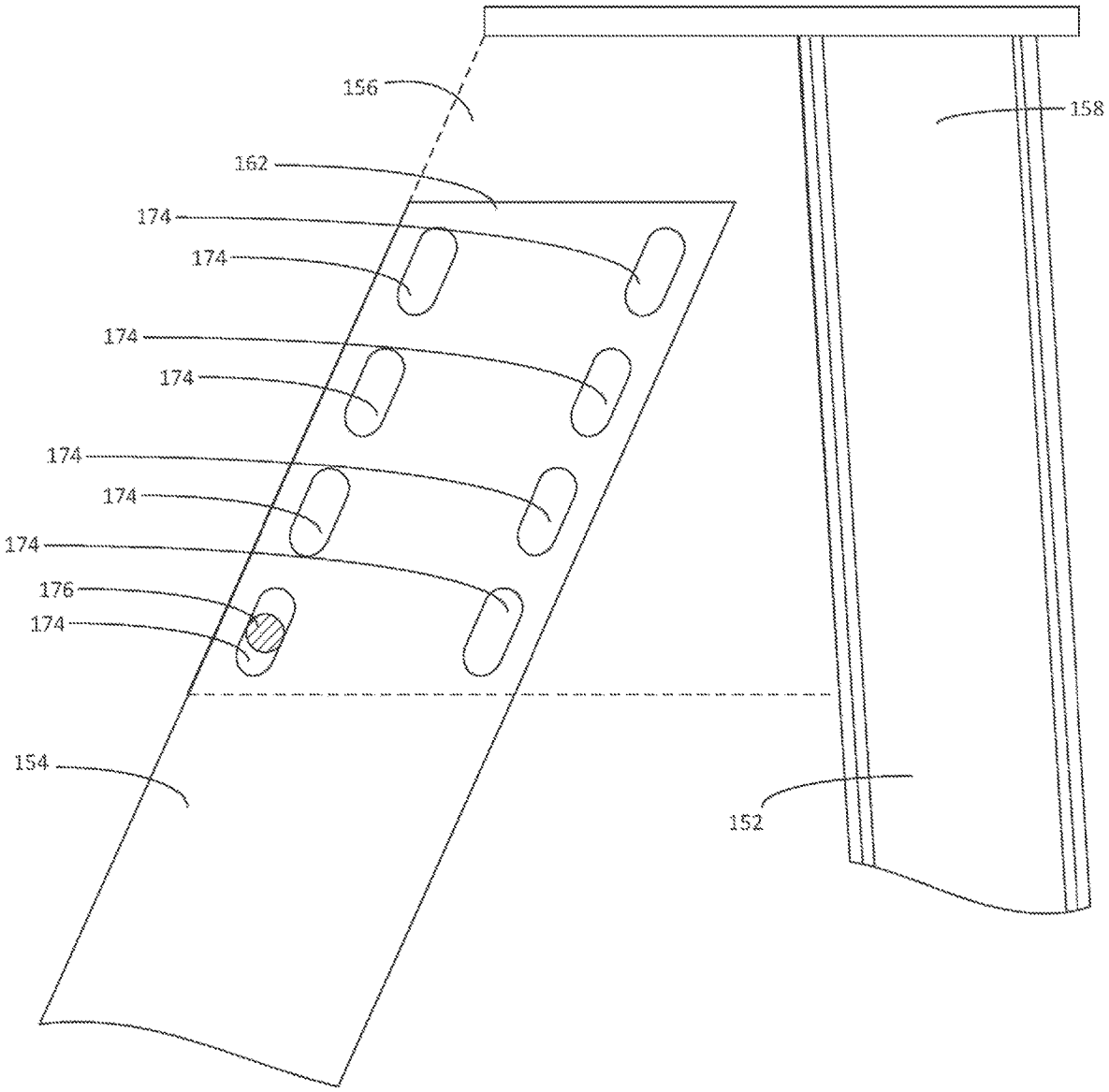
FIG. 4 is a side view of the proximal portion of the rear leg superimposed above the connection bracket of FIG. 3.

Turning to FIG. 4, shown therein is the proximal end 164 of the rear leg 154 within the connection bracket 156 (shown in dashed lines). The rear leg 154 includes a plurality of leg bolt holes 174. Each of the leg bolt holes 174 is sized and located to match with a corresponding one of the bracket bolt holes 170, 172. In exemplary embodiments, each of the leg bolt holes 174 is elongated along an axis that is parallel to the longitudinal axis extending through the rear leg 154. In this way, the rear leg 154 can be shifted up or down within the connection bracket 156 to adjust the effective length of the rear leg 154. The rear leg 154 is retained within the connection bracket 156 by leg connection bolts 176.

Figure 5A:
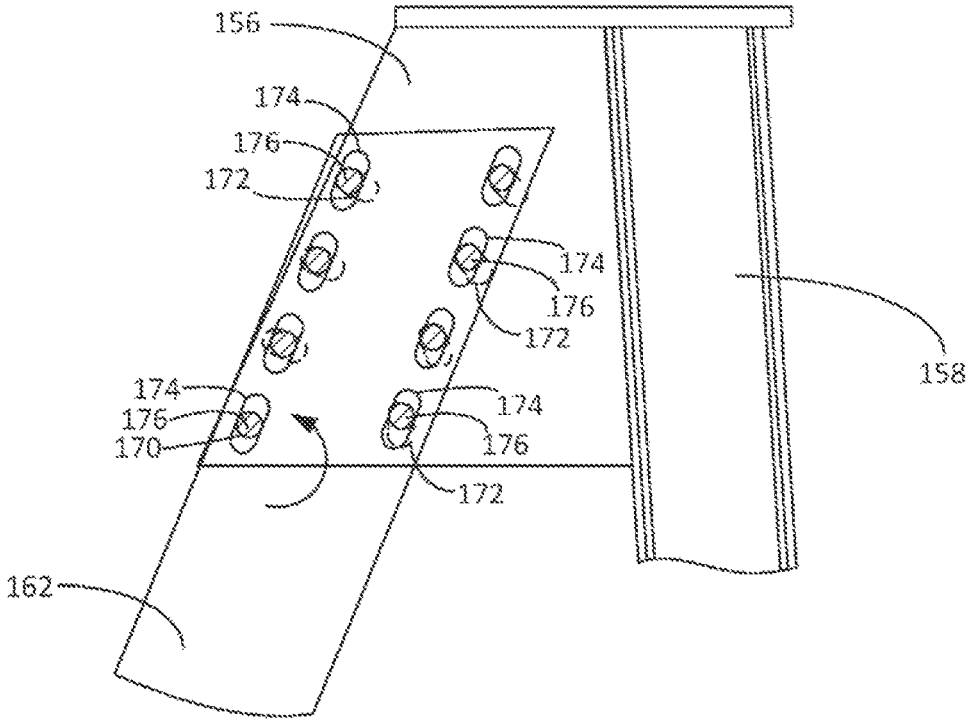
FIGS. 5A and 5B are side views of the rotational engagement of the proximal end of the leg with the connection bracket of FIG. 3.
Figure 5B:
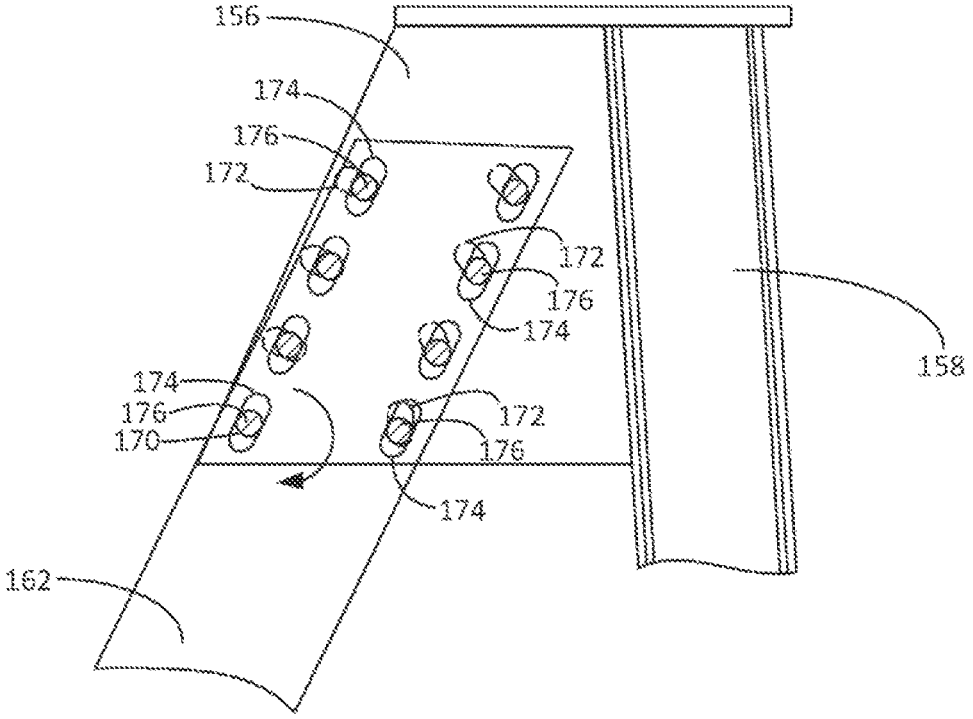

Turning to FIGS. 5A, 5B and FIGS. 6A, 6B, shown therein are depictions of the adjustable engagement of the proximal end 164 of the rear leg 154 with the connection bracket 156. In FIG. 5A, the rear leg 154 has been rotated counterclockwise within the connection bracket 156. In FIG. 5B, the rear leg 154 has been rotated clockwise within the connection bracket 156. This rotational movement is made possible by the arcuate pattern of the elongated compensating bracket bolt holes 172 that allow the rear leg to rotate with respect to the leg connection bolts 176.

Figure 6A:
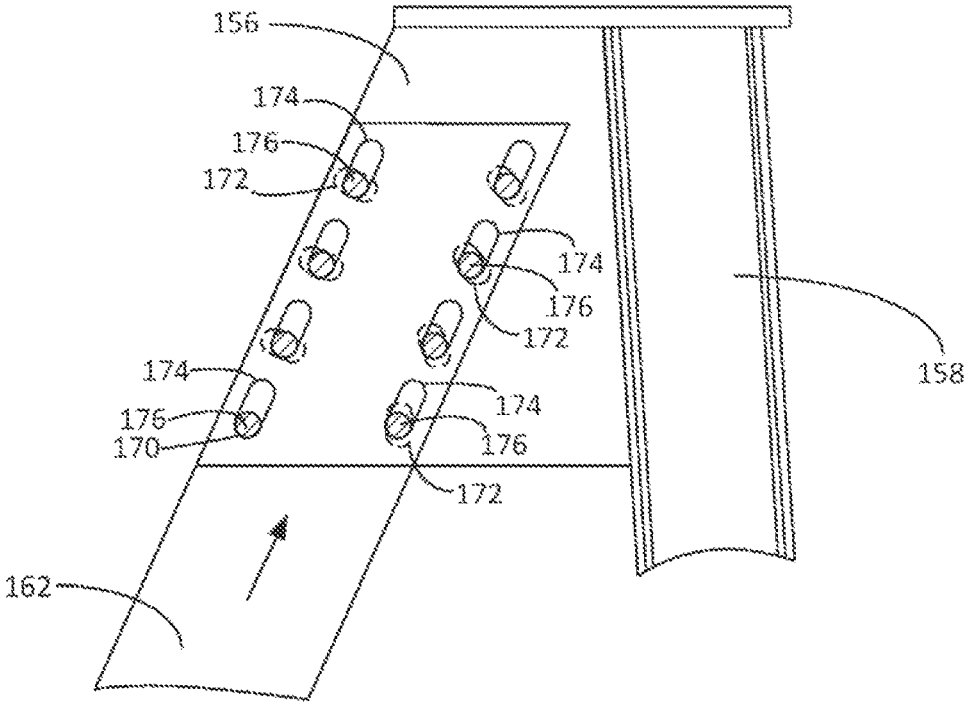
FIGS. 6A and 6B are side views of the linear engagement of the proximal end of the leg with the connection bracket of FIG. 3.
Figure 6B:
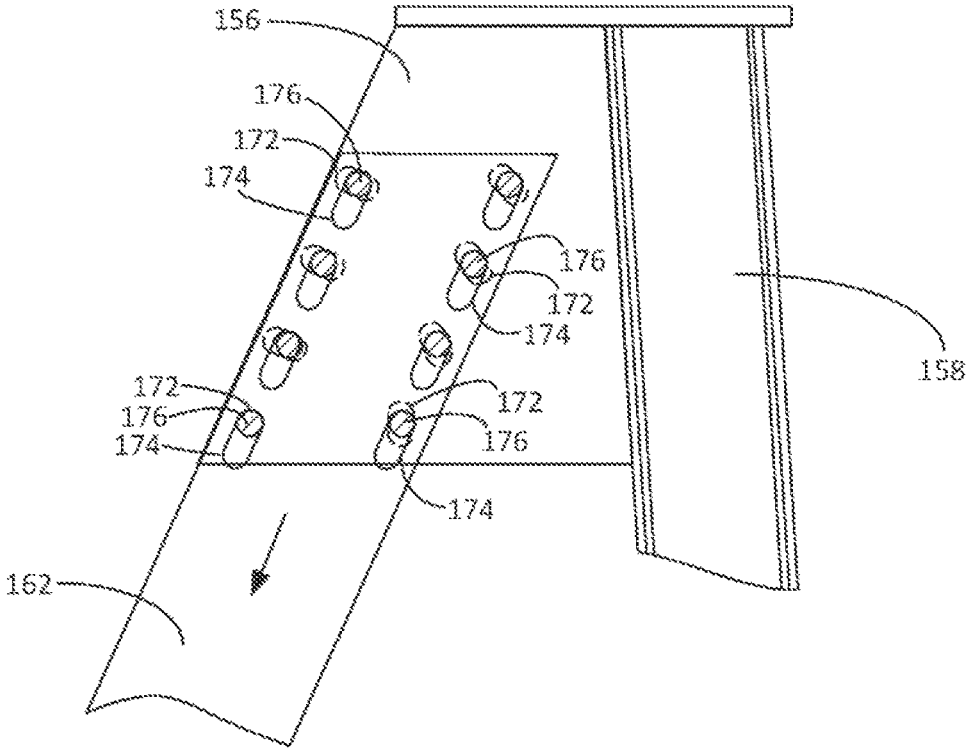

In FIG. 6A, the rear leg 154 has been shifted upward within the connection bracket 156 to reduce the effective length of the rear leg 154. In FIG. 6B, the rear leg 154 has been shifted downward within the connection bracket 156 to increase the effective length of the rear leg 154. The linear mode of adjustment is made possible by the elongated leg bolt holes 174 that allow the rear leg 154 to shift up and down with respect to the leg connection bolts 176.

Once the desirable position of the rear leg 154 within the bracket 156 has been established, the position of the rear leg 154 within the connection bracket 156 can be fixed by tightening the leg connection bolts 176. Shims or spacers can be placed into the compensating bracket bolt holes 172 and leg bolt holes 174 against the leg connection bolts 176 to further restrain the rear foot 116 from movement. It will be understood that the rear leg 154 can be positioned using a combination of rotational and linear modes of movement.

Figure 7:
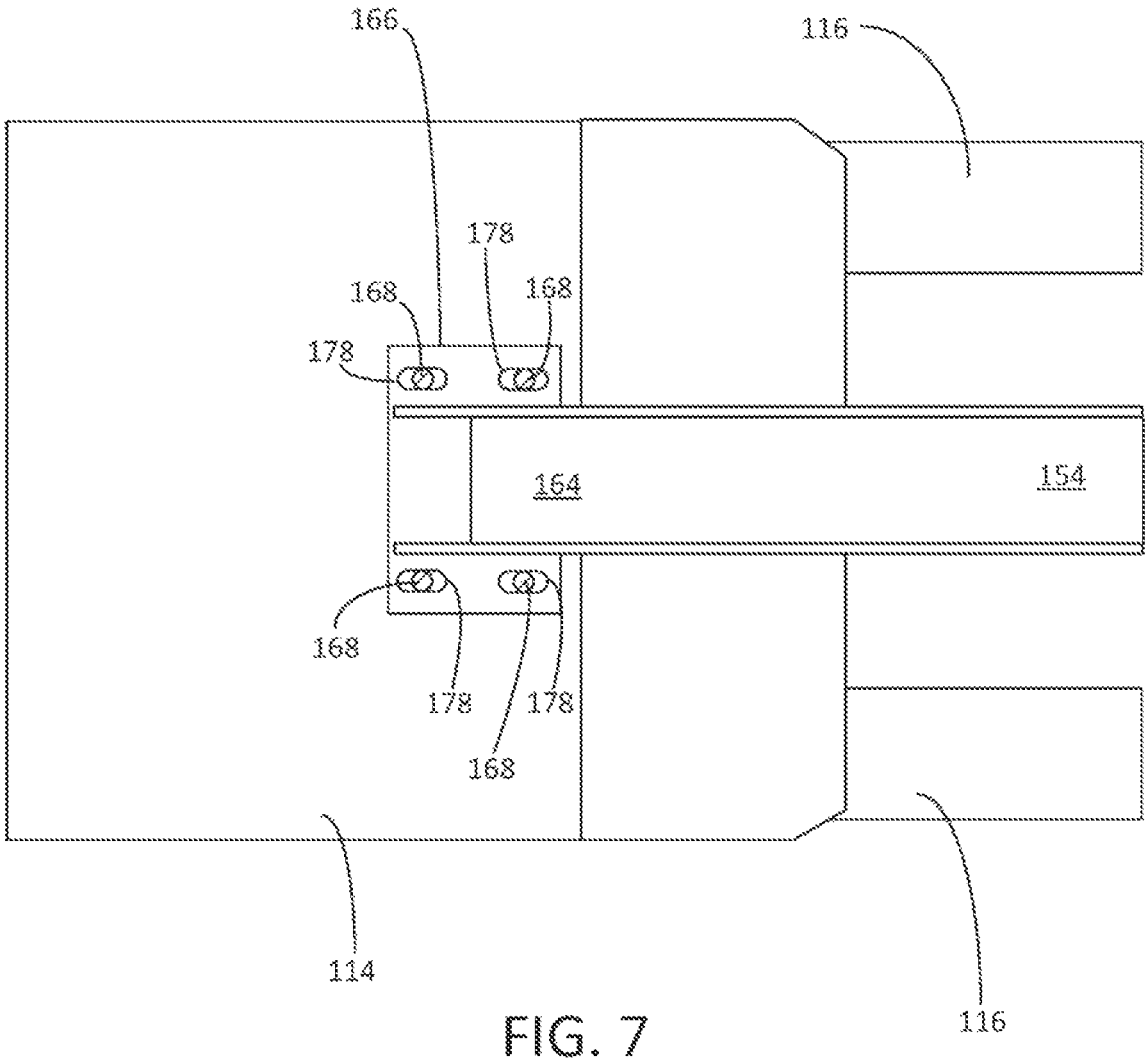
FIG. 7 is a top view of the rear leg foot secured to the pedestal.

Turning to FIG. 7, shown therein is a top view of the pedestal 114 and the rear foot 166. The adjustment of the length and rotational position of the rear leg 154 will affect the placement of the rear foot 166 on the pedestal 114. To accommodate for this change, the rear foot includes slotted pedestal bolt holes 178. The slotted pedestal bolt holes 178 are aligned over corresponding stationary bolt holes in the pedestal 114 (not shown). This permits the rear foot 166 to shift forward and backward on the pedestal 114 during assembly. The rear foot 116 can be locked into position on the pedestal 114 by tightening Samson pedestal bolts 168. Shims or spacers can be placed into the pedestal bolt holes 178 against the Samson pedestal bolts 168 to further restrain the rear foot 116 from movement once the desired position is obtained.

In an exemplary embodiment, the Samson post 118 is assembled by first securing the front leg 152 to the base 116. The proximal end 162 of the rear leg 154 can then be inserted into the connection bracket 156 and loosely pinned with a single leg connection bolt 176 through the reference bracket bolt hole 170. The rear leg 154 can then be rotated into a position in which the rear foot 166 rests flat on the surface of the pedestal 114. This may cause the rear leg 154 to shift up or down within the connection bracket 156. Once the rear leg 154 has been moved into the desired position, the balance of the leg connection bolts 176 and Samson pedestal bolts 168 can be inserted and tightened to lock the rear leg 154 into position. This method of assembly ensures that the rear foot 166 does not contact the pedestal at an angle and minimizes the amount of stress transferred to the Samson pedestal bolts 168.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A pump jack comprising:

a base;

a pedestal supported by the base; and a Samson post, wherein the Samson post comprises:

a front leg supported by the base;

a connection bracket affixed to the front leg, the connection bracket comprising a reference bracket bolt hole and a plurality of compensating bracket bolt holes, wherein each of the plurality of compensating bracket bolt holes is an elongated bolt hole having a linear axis extending along a length of the elongated bolt hole and aligned along an arc of a circle that has a center at the reference bracket bolt hole; and an adjustable rear leg connected between the connection bracket and the pedestal.

2. The pump jack of claim 1, wherein the connection bracket is welded to the front leg.

3. The pump jack of claim 1, wherein the rear leg includes a proximal end that includes a plurality of leg bolt holes.

4. The pump jack of claim 3, wherein each of the plurality of leg bolt holes is elongated along an axis that is parallel with a longitudinal axis of the rear leg.

5. The pump jack of claim 4, further comprising a plurality of leg connection bolts, wherein each of the plurality of leg connection bolts passes through a corresponding pair of compensating bracket bolt holes and leg bolt holes.

6. The pump jack of claim 1, wherein the Samson post further comprises a rear foot that is rigidly fixed to the rear leg.

7. The pump jack of claim 6, wherein the rear foot includes a plurality of elongated pedestal bolt holes.

8. The pump jack of claim 7, wherein the rear foot is secured to the pedestal with a plurality of pedestal bolts, wherein each of the plurality of pedestal bolts passes through a corresponding one of the pedestal bolt holes.

9. A pump jack comprising:

a base;

a pedestal supported by the base; and a Samson post, wherein the Samson post comprises:

a front leg supported by the base;

a connection bracket affixed to the front leg, the connection bracket comprising a reference bracket bolt hole and a plurality of compensating bracket bolt holes, wherein each of the plurality of compensating bracket bolt holes is an elongated bolt hole having a linear axis extending along a length of the elongated bolt hole and aligned along an arc of a different circle and wherein each of the different circles has a common center at the reference bracket bolt hole; and a rear leg connected between the connection bracket and the pedestal, wherein the position of the rear leg within the connection bracket can be adjusted.

10. The pump jack of claim 9, wherein the rear leg can be shifted linearly up and down within the connection bracket.

11. The pump jack of claim 9, wherein the rear leg can be rotated within the connection bracket.

12. The pump jack of claim 9, wherein the Samson post further comprises a rear foot attached to the rear leg and the pedestal, wherein the rear foot comprises a plurality of pedestal bolt holes that allow the rear foot to be secured to the pedestal at multiple positions.

13. A method of assembling a pump jack, the method comprising the steps of:

providing a base;

providing a front leg of a Samson post, wherein a connection bracket is attached to the front leg, the connection bracket comprising a reference bracket bolt hole and a plurality of compensating bracket bolt holes, wherein each of the plurality of compensating bracket bolt holes is an elongated bolt hole having a linear axis extending along a length of the elongated bolt hole and aligned along an arc of a circle that has a center at the reference bracket bolt hole;

providing a rear leg of the Samson post, wherein the rear leg has a proximal end, a distal end and a rear foot attached to the distal end;

securing a pedestal on the base, where the pedestal has a top surface;

attaching a lower end of the front leg to the base at a predetermined location;

attaching the proximal end of the rear leg to the connection bracket in an initial position;

moving the distal end of the rear leg of the Samson post to a final position in which the rear foot is flat on the top surface of the pedestal; and securing the rear leg and rear foot in the final position.

14. The method of claim 13, wherein the step of attaching a proximal end of the rear leg of the Samson post to the connection bracket in an initial position further comprises pinning the proximal portion of the rear leg to the connection bracket with a leg connection bolt through the reference bracket bolt hole.

15. The method of claim 14, wherein the step of moving the distal end of the rear leg of the Samson post to a final position comprises rotating the rear leg about the reference bracket bolt hole.

16. The method of claim 14, wherein the step of moving the distal end of the rear leg of the Samson post to a final position comprises shifting the rear leg up or down within the connection bracket.

* * * * *